US008004265B2

(12) United States Patent
Wei et al.

(10) Patent No.: US 8,004,265 B2
(45) Date of Patent: Aug. 23, 2011

(54) VARIABLE REFERENCE VOLTAGE GENERATING CIRCUIT USING CONTROLLED SWITCHES

(75) Inventors: Chun Kai Derrick Wei, Hsinchu County (TW); Kuan-Yeu Chen, Hsinchu Hsien (TW); Hung I Wang, Hsinchu County (TW); Song-Yi Lin, Taipei (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 231 days.

(21) Appl. No.: 12/249,302

(22) Filed: Oct. 10, 2008

(65) Prior Publication Data

US 2009/0167280 A1 Jul. 2, 2009

(30) Foreign Application Priority Data

Jan. 2, 2008 (TW) ..... 97200053 U

(51) Int. Cl.
*G05F 3/16* (2006.01)

(52) U.S. Cl. ..... 323/313; 323/314; 307/125

(58) Field of Classification Search ..... 323/313, 323/314; 307/125
See application file for complete search history.

(56) References Cited

U.S. PATENT DOCUMENTS 4,751,497 A * 6/1988 Torii ..... 341/154
5,781,141 A * 7/1998 Ikuta et al. ..... 341/154
5,838,076 A * 11/1998 Zarrabian et al. ..... 307/115
5,969,658 A * 10/1999 Naylor ..... 341/154

* cited by examiner

*Primary Examiner* — Bao Q Vu
(74) *Attorney, Agent, or Firm* — WPAT, PC; Justin King

(57) ABSTRACT

A voltage generating circuit for generating a plurality of associated voltages includes a constant current source for generating a constant current; a plurality of resistors connected in series to the constant current source in series for generating a plurality of associated reference voltages; and a first controlled switch connected to a first resistor in parallel, wherein the plurality of associated reference voltages are changed by optionally conducting the first controlled switch to control the flow of the constant current through the first resistor.

4 Claims, 6 Drawing Sheets

VARIABLE REFERENCE VOLTAGE GENERATING CIRCUIT USING CONTROLLED SWITCHES

FIELD OF THE INVENTION

The present invention relates to a voltage generating circuit, and more particularly, to a voltage generating circuit used in integrated circuits.

BACKGROUND OF THE INVENTION

In an integrated circuit system, when several different levels of reference voltages are needed under various circumstances, a voltage generating circuit is provided therein as shown in FIG. 1. Wherein, a constant current source Ic is used for supplying a constant current, which passes through a plurality of serially connected resistors R1, R2, and R3 . . . Rn. Accordingly, a first reference voltages Vr1, a second reference voltage Vr2, a third reference voltage Vr3, . . . and an Nth reference voltage Vrn are derived from a first node N1, a second node N2, a third node N3, . . . and a Nth node Nn, respectively, followed by forming a plurality of contacts Vo1 . . . Vom via a plurality of multiplexers 11 . . . 1*m*. The needed reference voltages are then selected by way of controlling the multiplexers.

However, the circuit architecture mentioned above has two disadvantages. First, the design of the multiplexers 11 . . . 1*m* increases circuit complexity. Moreover, a leakage current of the multiplexers may undesirably influence an accuracy of the output reference voltages. Secondly, several reference voltages are supplied by the plurality of contacts, resulting in complications in the subsequent circuit in which the proper reference voltages are only obtained by switching the contacts. Therefore, it is a primary object of the present invention as to how to overcome the abovementioned disadvantages.

SUMMARY OF THE INVENTION

A voltage generating circuit for generating a plurality of associated voltages according to the present invention comprises a constant current source; a plurality of resistors, connected in series to the constant current source for generating a plurality of voltages; and a controlled switch, connected in parallel to one the serially connected resistors, wherein the voltage differences among the plurality of voltages are changed by turning on or off the controlled switch.

According to the proposition described above, a voltage generating circuit according to the present invention further comprises a second controlled switch connected in parallel to a second resistor among the serially connected resistors, wherein the voltage levels of the plurality of voltages are changed by turning on or off the second controlled switch.

According to another aspect of the present invention, a voltage generating circuit for generating a plurality of associated voltages comprises a constant current source; and a plurality of resistors, connected in series to the constant current source for generating a plurality of voltages; and a controlled switch, connected in parallel to one resistor among the serially connected resistors, wherein the voltage levels of the plurality of voltages are changed by turning on or off the controlled switch.

According to the proposition described above, a voltage generating circuit according to the present invention further comprises a second controlled switch connected in parallel to a second resistor among the serially connected resistors, wherein the voltage differences among the plurality of voltages are changed by turning on or off the second controlled switch.

Moreover, according to the present invention, a voltage generating circuit for generating a plurality of associated voltages comprises a constant current source; a plurality of resistors connected in series to the constant current source for generating a plurality of voltages; and a plurality of controlled switches each connected in parallel to one corresponding resistor among the serially connected resistors, wherein the plurality of voltages are changed by turning on or off one or more of the controlled switches.

According to the proposition described above, a voltage generating circuit according to the present invention, wherein the number of the controlled switches is not greater than the number of the serial resistors.

Furthermore, a voltage generating circuit according to the present invention comprises a constant current source for generating a constant current; a first resistor electrically connected in series to the constant current source for generating a voltage; a second resistor, electrically connected in series to the first resistor and a ground point; and a controlled switch, connected in parallel to the second resistor, wherein the voltage is changed by turning on or off the controlled switch.

BRIEF DESCRIPTION OF THE DRAWINGS

Preferred embodiments of the present invention will become more readily apparent to those ordinarily skilled in the art after reviewing the following detailed description and accompanying drawings, in which.

DETAILED DESCRIPTION OF THE PREFERRED EMBODIMENT

Figure 1:
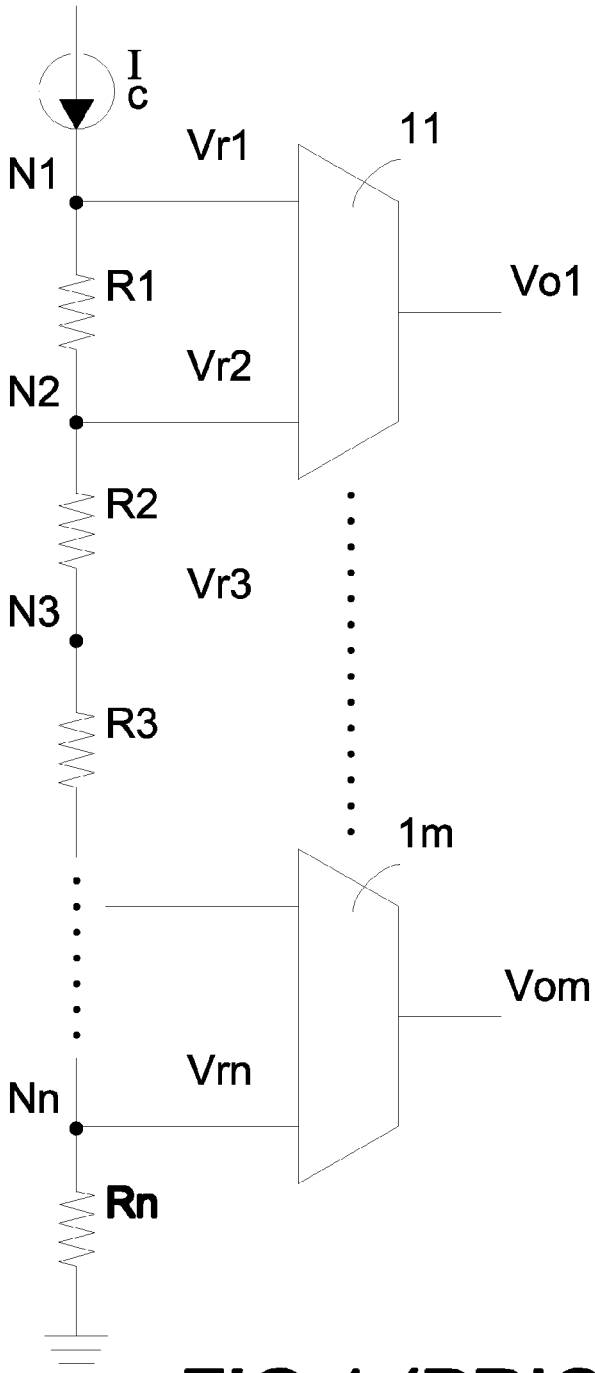
FIG.1 (PRIOR ART)
FIG. 1 shows a schematic diagram of a conventional voltage generating circuit.
Figure 2:
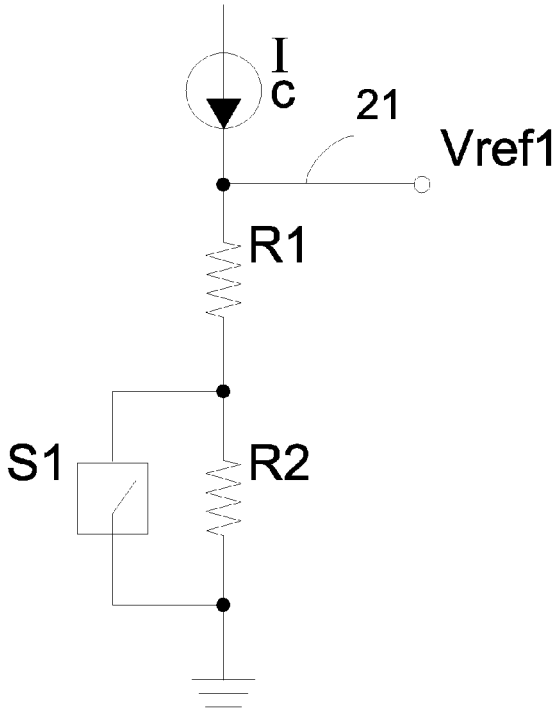
FIG. 2 shows a schematic diagram of a voltage generating circuit in accordance with a first preferred embodiment of the present invention for overcoming the disadvantages of the prior art.

Referring to FIG. 2 showing a schematic diagram of a voltage generating circuit in accordance with a first embodiment of the present invention for overcoming the disadvantages of the prior art, the voltage generating circuit comprises a constant current source Ic; a first resistor R1 electrically connected in series to the constant current source Ic, and deriving a first reference voltage Vref1 at a first voltage output end 21; a second resistor R2 electrically connected in series to the first resistor R1 and a ground point; and a first controlled switch S1 connected in parallel to the second resistor R2;

wherein the first reference voltage Vref1 of the first voltage output end 21 is changed by optionally conducting the first controlled switch S1. In this embodiment, when the first controlled switch S1 is off, Vref1 is Ic×(R1+R2); when switch S1 is on, Vref1 is Ic×(R1). Accordingly, without requiring provision of multiplexers, a reference voltage of different levels is supplied at a same output end, which is the first voltage output end 21 in this embodiment.

Figure 3:
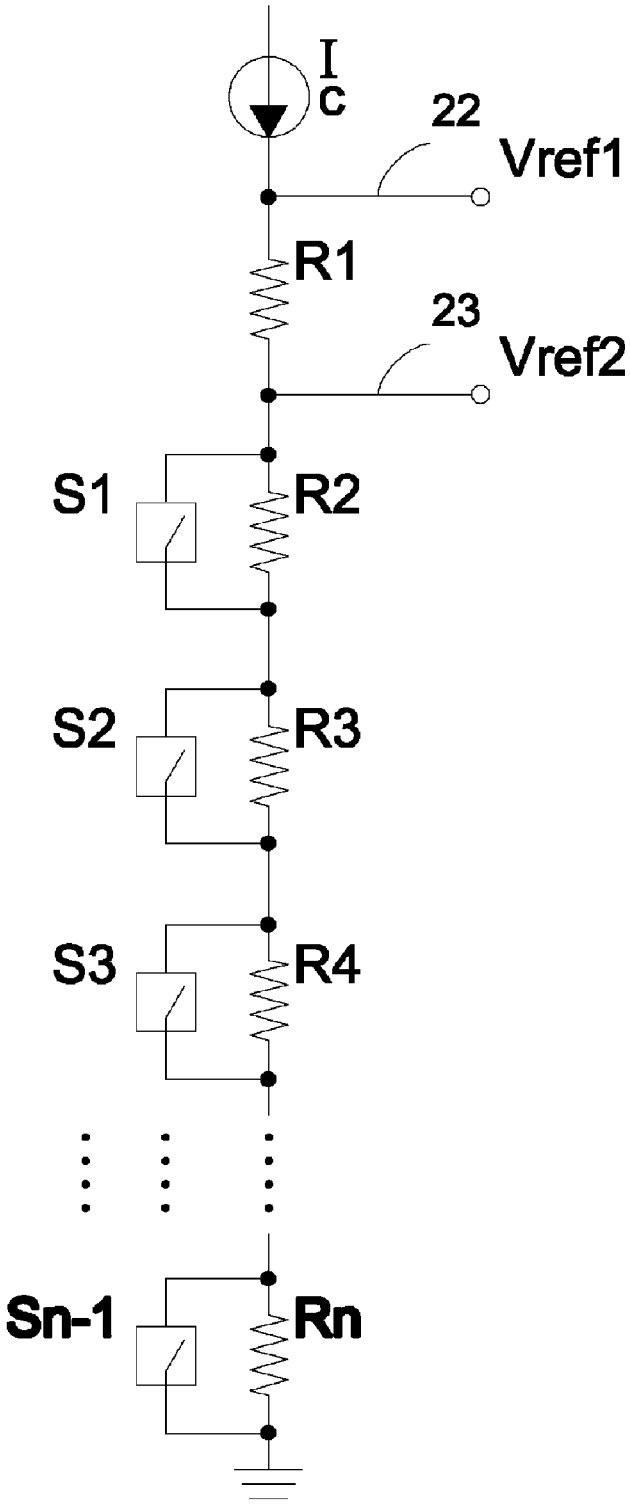
FIG. 3 shows a schematic diagram of a voltage generating circuit in accordance with a second preferred embodiment of the present invention for overcoming the disadvantages of the prior art.

FIG. 3 shows a schematic diagram of a voltage generating circuit in accordance with a second embodiment of the present invention for overcoming the conventional disadvantages. Similarly to the first embodiment, the second embodiment comprises a constant current source Ic, a first resistor R1, a second resistor R2, and a first controlled switch S1. The second embodiment further includes resistors R3, R4 . . . Rn connected in series between the second resistor R2 and a ground point. The second embodiment also includes additional of controlled switches S2, S3 . . . Sn-1 connected in parallel to resistors R3, R4 . . . Rn, respectively. Accordingly, a first reference voltage Vref1 at a first voltage output end 22 and a second reference voltage Vref2 at a second voltage output end 23 are changed by optionally conducting the controlled switches S1, S2, and S3 . . . Sn-1. In this embodiment, Vref1 and Vref2 rise or fall simultaneously by optionally conducting one or more of the controlled switches, and maintain a constant voltage difference as Ic×R1 between the two. Accordingly, without any multiplexer, this embodiment provides two reference voltages, Vref1 and Vref2, with a constant voltage difference at two output ends 22 and 23.

Figure 4:
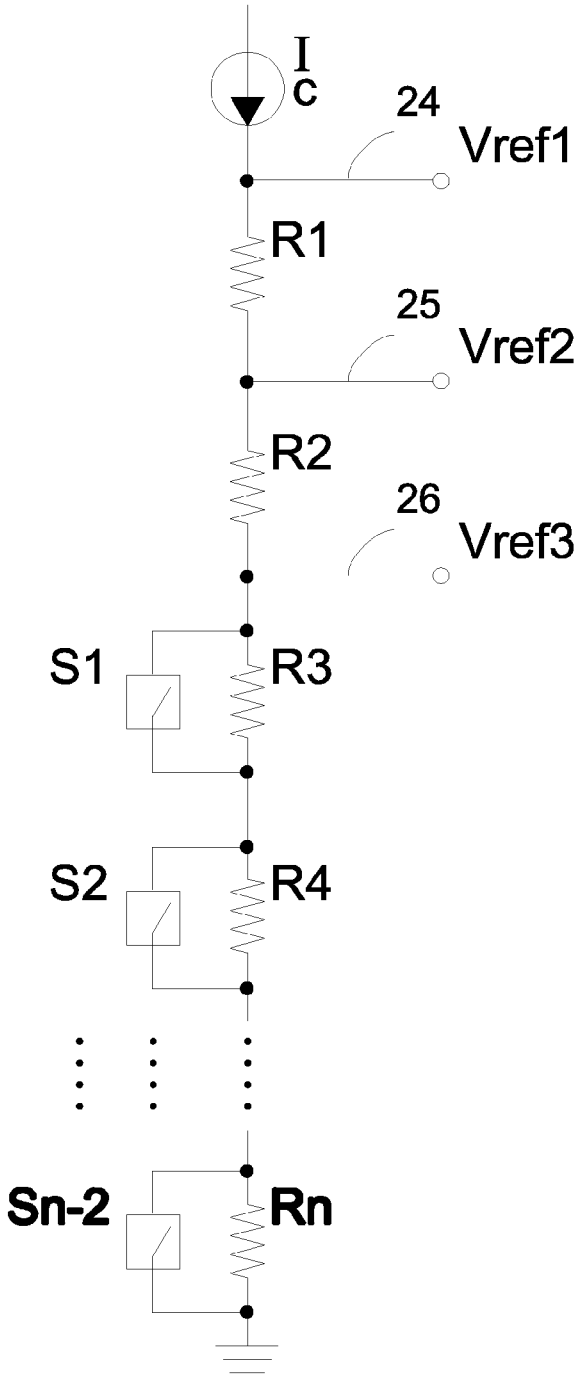
FIG. 4 shows a circuit diagram of a voltage generating circuit in accordance with a third preferred embodiment of the present invention for overcoming the disadvantages of the prior art.

FIG. 4 shows a schematic diagram of a circuit in accordance with a third embodiment of the present invention. The third embodiment includes three voltage output ends, the first voltage output end 24, a second voltage output end 25, and a third voltage output end 26. This embodiment includes a plurality of resistors R4 . . . Rn connected in series between a third resistor R3 and a ground point, and a plurality of controlled switches S1 and S2 . . . Sn-2 are connected in parallel to resistors R3 and R4 . . . Rn, respectively. Accordingly, a first reference voltage Vref1, a second reference voltage Vref2, and a third reference Vref3 at the three voltage output ends are changed by optionally conducting one or more of the controlled switches S1, S2, S3, . . . , and Sn-2. In this embodiment, Vref1, Vref2 and Vref3 rise or fall simultaneously by optionally conducting one or more of the controlled switches; moreover, this embodiment provides a first constant voltage difference Ic×R1 between Vref1 and Vref2, and a second constant voltage difference Ic×R2 between Vre2 and Vref3. Accordingly, without any multiplexer, this embodiment provides reference voltages, Vref1, Vref2 and Vref3, with constant voltage differences at three same output ends 24, 25, and 26.

Figure 5:
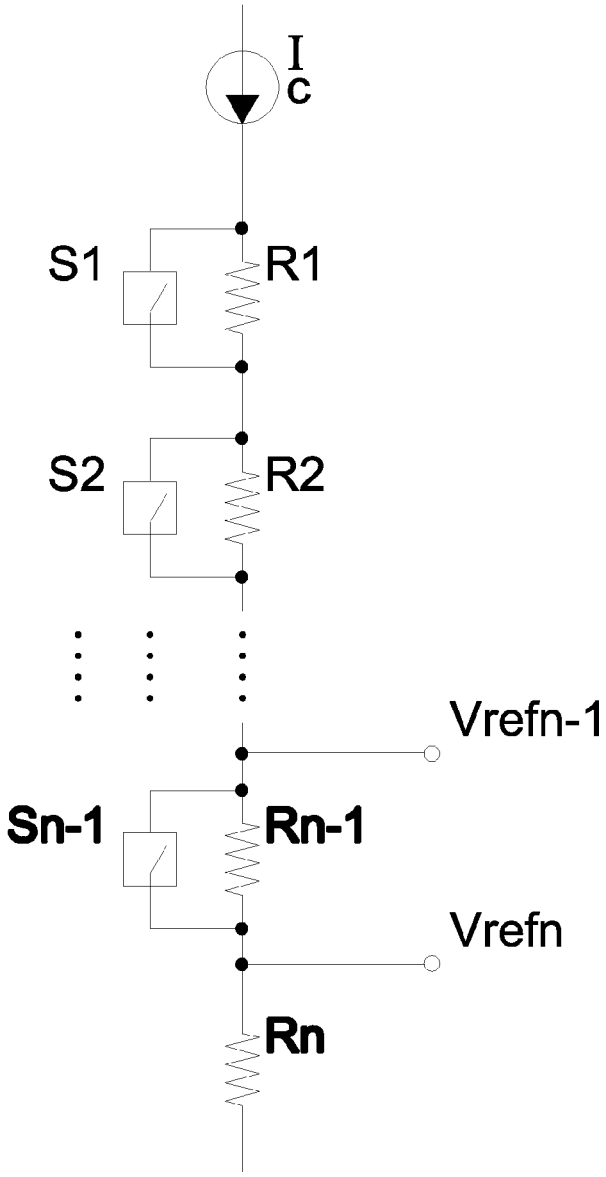
FIG. 5 shows a circuit diagram of a voltage generating circuit in accordance with a fourth preferred embodiment of the present invention for overcoming the disadvantages of the prior art.

FIG. 5 shows a schematic diagram of a circuit in accordance with a fourth preferred embodiment of the present invention. The fourth embodiment operates similarly to the previously discussed embodiments. The fourth embodiment provides different voltage output positions in comparison to the previously discussed embodiments. This embodiment includes a constant current source Ic, a plurality of resistors R1 . . . Rn connected in series between the Ic and a ground point, a plurality of controlled switches S1 . . . Sn-1 connected in parallel to each of the resistor R1 . . . Rn-1 respectively, and two reference voltages Vrefn-1 and Vrefn wherein the Rn-1 and Sn-1 are positioned between Vrefn-1 and Vrefn. This embodiment provides a constant voltage difference between Vrefn-1 and Vrefn while optionally conducting controlled switches S1 . . . Sn-2. The Vrefn-1 and Vrefn are rise and fall simultaneously by optionally conducting controlled switched S1 . . . Sn-2. This embodiment further provides a function to change the voltage difference between Vrefn-1 and Vrefn by optionally conducting the controlled switch Sn-1.

Figure 6:
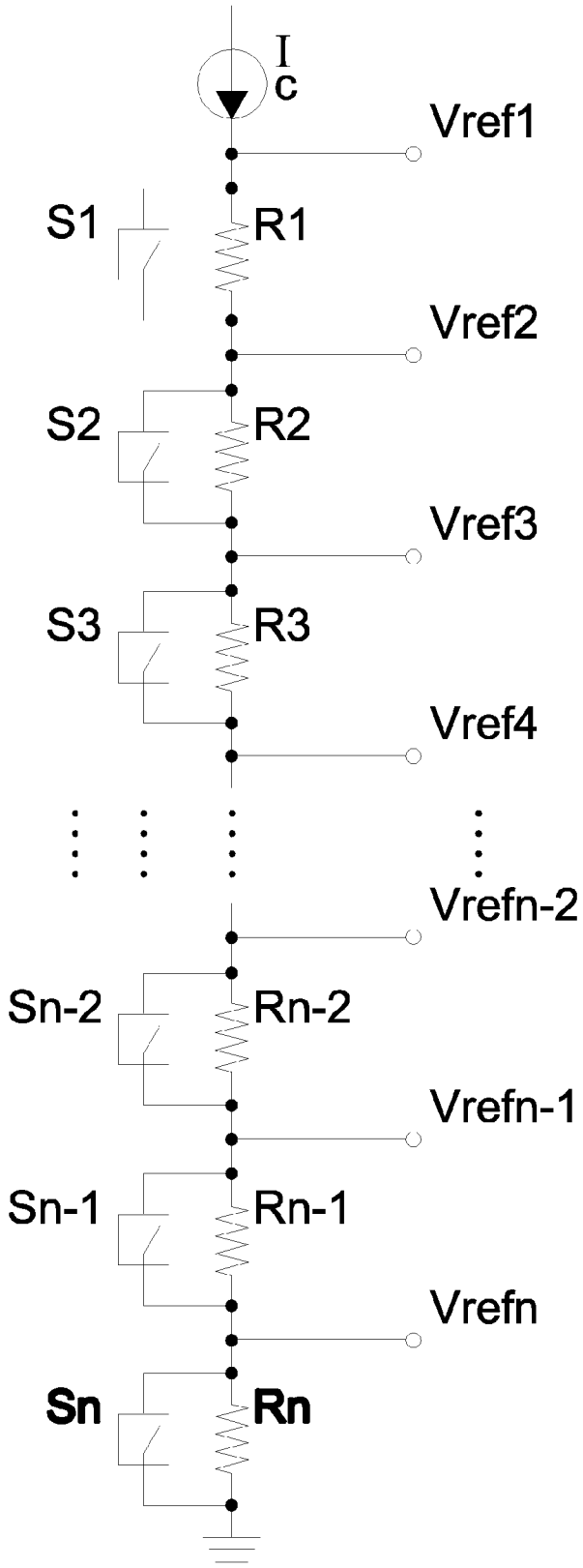
FIG. 6 shows a circuit diagram of a voltage generating circuit in accordance with a fifth preferred embodiment of the present invention for overcoming the disadvantages of the prior art.

FIG. 6 shows a schematic diagram of a circuit in accordance with a fifth embodiment of the present invention. The circuit according to this embodiment combines characteristics of the voltage generating circuit according to the foregoing embodiments while having a better flexibility. This embodiment includes a constant current source Ic for supplying a constant current for passing through a plurality of serially connected resistors R1 and R2 . . . Rn; each of the resistors is correspondingly connected in parallel to one of controlled switches S1 and S2 . . . Sn. Accordingly, each of reference voltage Vref1, and Vref2 . . . Vrefn is derived from a node, such that a circuit designer may designate any of the abovementioned reference voltages for other circuits as needed. For example, Vref1 and Vref4 from a plurality of reference voltages are selected to serve as reference voltages of a first circuit (not shown) and a second circuit (not shown), respectively. Voltage values of Vref1 and Vref4 are simultaneously changed by optionally conducting one or more of the controlled switches S4 . . . Sn, while a voltage difference between Vref1 and Vref4 is kept constant. However, the voltage difference between Vref1 and Vref4 can be changed by optionally conducting one or more of the controlled switches S1, S2, and S3.

In summary, a voltage generating circuit according to the present invention effectively overcomes the disadvantages of conventional voltage generating circuits. The uncomplicated structure according to the present invention supplies a stable source of flexible reference voltages, and it can be widely used in all kinds of integrated circuit chips. While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A voltage generating circuit for generating a first reference voltage and a second reference voltage with a voltage difference, comprising:

a constant current source;

a ground point;

a first resistor, coupled to said constant current source, for generating said first reference voltage at a first voltage output end located at a first point between said first resistor and said constant current source;

a second resistor, coupled between said first resistor and said ground point, for generating said second reference voltage at a first voltage output end located at a second point between said first resistor and said second resistor; and a first controlled switch, connected in parallel to said second resistor for determining the first and second reference voltage;

wherein said first resistor and said second resistor are connected in series between said constant current source and said ground point, and said voltage difference is fixed between said first reference voltage and said second reference voltage regardless of the state of the first controlled switch.

2. The voltage generating circuit as claimed in claim 1, further comprising:

a second controlled switch, connected in parallel to said first resistor, for controlling said fixed voltage difference between said first reference voltage and said second reference voltage.

3. A voltage generating circuit for generating a plurality of reference voltages, comprising:

a constant current source;

a ground point;

a plurality of resistors, connected in series between said constant current source and said ground point, for generating said reference voltages at the high voltage ends of said resistors;

a plurality of controlled switches connected in parallel to each corresponding resistor of said resistors respectively, for controlling said reference voltages and a voltage difference between two of said reference voltages;

a plurality of reference voltage output ends located at the high voltage ends of said resistors, logically preceding each corresponding resistor and associated controlled switch connection node, for enabling flow of said reference voltages to an associated circuit;

wherein the voltage difference between any two reference voltages remains constant regardless of the state of the plurality of controlled switches in the circuit.

4. The voltage generating circuit as claimed in claim 3, wherein, the number of the controlled switches is not greater than the number of the serial resistors.

* * * * *